United States Patent [19]

Donatt

[11] Patent Number: 4,531,338

[45] Date of Patent: Jul. 30, 1985

[54] BUILDING WALL PANEL

[75] Inventor: Norman L. Donatt, Bellevue, Wash.

[73] Assignee: Olympian Stone Company, Redmond, Wash.

[21] Appl. No.: 504,390

[22] Filed: Jun. 15, 1983

[51] Int. Cl.[3] ..... E04B 2/28

[52] U.S. Cl. ..... 52/235; 52/474; 52/506; 52/587; 52/745

[58] Field of Search ..... 52/474, 483, 593, 583, 52/587, 600, 235, 506, 510–513, 601, 602, 743, 745

[56] References Cited

U.S. PATENT DOCUMENTS

| | | | |
|---|---|---|---|
| 1,208,299 | 12/1916 | Cutler . | |
| 1,285,051 | 11/1918 | Cramer . | |
| 1,461,452 | 10/1923 | Pritchard | 52/587 X |
| 1,624,802 | 4/1927 | Rebell | 52/587 X |
| 2,151,399 | 3/1939 | White | 52/587 X |
| 2,200,636 | 5/1940 | Palmer . | |
| 2,307,293 | 1/1943 | Paul et al. . | |
| 2,664,978 | 1/1954 | Fox | 52/474 |
| 3,299,601 | 1/1967 | Chiville . | |
| 3,350,830 | 11/1967 | Smith, Jr. et al. . | |
| 3,722,160 | 3/1973 | Bentley | 52/587 X |
| 3,958,384 | 5/1976 | Megumi . | |
| 4,009,549 | 3/1977 | Hala . | |
| 4,045,933 | 9/1977 | Grillo . | |
| 4,060,951 | 12/1977 | Gere . | |
| 4,064,664 | 12/1977 | Gaul | 52/235 X |
| 4,084,362 | 4/1978 | Piazza . | |
| 4,185,437 | 1/1980 | Robinson . | |
| 4,223,502 | 9/1980 | Robinson . | |
| 4,364,213 | 12/1982 | Biesanz, Sr. . | |

*Primary Examiner*—Donald G. Kelly
*Assistant Examiner*—Richard E. Chilcot, Jr.
*Attorney, Agent, or Firm*—Christensen, O'Connor, Johnson & Kindness

[57] ABSTRACT

A building wall panel (14) is adapted to be mounted directly on the framework of a building and includes an exterior facing composed of thin, presized masonry panels (16) of, for instance, granite or marble, mounted on a support frame (18) by a plurality of attachment assemblies (24). Each attachment assembly (24) also includes a first subassembly composed of a pair of studs (30) extending diagonally rearwardly from panel (16) to extend within a pocket (28) defined by an enclosure member (26) of a second attachment subassembly secured to the support frame (18). The studs (30) together form a forwardly open bight which loops around a crosspin (32) extending through the enclosure member, through the interior of pocket (28) to engage with support frame (18). Pocket (28) is filled with a bonding medium (34) that creates a rigid interconnection between studs (30) and support frame (18).

22 Claims, 8 Drawing Figures

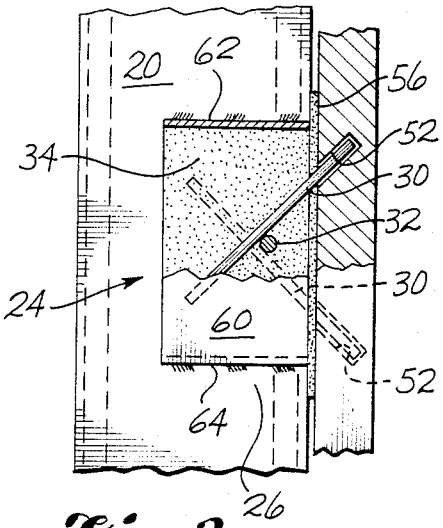
Fig. 3
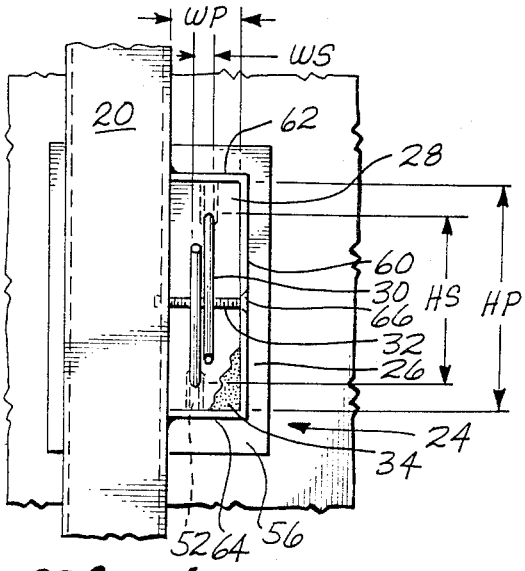
Fig. 4
Fig. 6
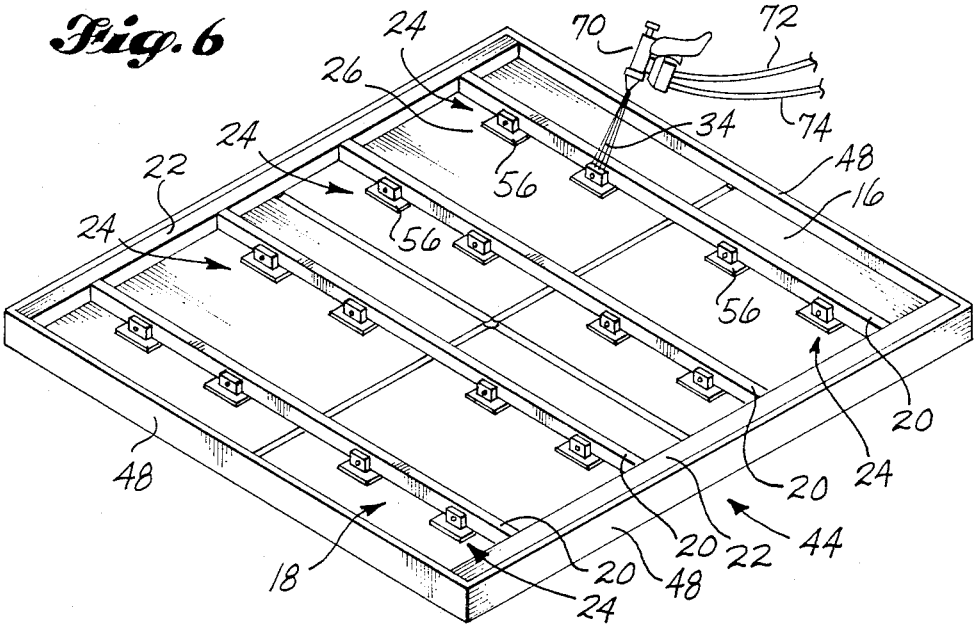

BUILDING WALL PANEL

TECHNICAL FIELD

The present invention relates generally to the building wall panel art, and more particularly to a framed wall panel having an exterior facade formed from thin panels of granite, marble, or other masonry.

BACKGROUND OF THE INVENTION

Granite, marble, and similar masonry products are considered to be highly desirable architectural materials for forming the exterior facade or facing of building structures. These materials are not only highly pleasing in appearance, but also very durable and require only a minimum of maintenance. This is borne out by the many marble or granite-faced building throughout the world that were constructed many decades ago and are still in use today. However, the scarcity of marble relative to the current demand and the unprecedented rise in the cost of construction labor have dramatically increased the cost of constructing buildings faced with marble or granite.

In an early construction method, still used today, selected pieces of facing material of marble or granite were hand-set directly on the structural steel skeleton or concrete frame of a building. The panels were held in place by bolts or similar hardware. In this type of construction, the panels of masonry facing material must be at least several inches thick to have the strength necessary to support their own weight without cracking. These panels are not only very costly to quarry and cut to size, but also are difficult to handle if made in a desirably large enough size to cover a building surface within a reasonable length of time. If the height and width of the panels are decreased to make them easier to handle, an increased number of panels are needed to cover the building surface, thereby increasing the number of time-consuming panel-mountings operations required.

Once the marble or granite facade has been attached to the steel or concrete framework or backing, a separate interior wall must be erected. Modern fire codes for commercial structures typically prohibit the use of flame-transmitting materials in the construction of the building walls. In addition, building codes now require that exterior walls be insulated to minimize heat loss in the winter and heat gain in the summer.

In another type of building wall panel, pairs of holes are drilled in the rear sides of the granite or marble panels. C-shaped clips are inserted within the holes and then a layer of glass fiber-reinforced concrete slurry is sprayed over the back surfaces of the granite or marble panels and around the anchor clips to form a solid backing layer. Before the cementitious backing layer sets up, a metal frame is placed over the backing layer and then a second cementitious layer is applied over the first layer and around the components of the frame to join the frame to the first layer. An example of a building panel constructed in this manner is disclosed by U.S. Pat. No. 3,299,601.

U.S. Pat. No. 4,223,502 discloses a building wall panel constructed somewhat similar to that disclosed in U.S. Pat. No. 3,299,601 with the exception that, rather than utilizing a preformed frame, after the cementitious backing layer is spread over the rear surfaces of the masonry panels, integral support ribs are formed from the same slurry material used to form the backing layer, with each rib extending laterally across the back surface of the backing layer. A drawback of this type of wall panel construction is that a significant amount of material and time is required to cover the rear surfaces of the masonry panels with the cementitious material.

In a further type of wall panel construction, a substantially flat rigid plate is sandwiched between individual masonry panels and in a metal backing framework. The individual panels are secured to the backing plate and backing framework by a plurality of anchor studs engaged within blind holes formed in the backsides of the panels. To assemble the building wall panel, the flat plate and metal framework are laid on the backsides of the masonry panels and then holes drilled through the framework and plate and partially through the masonry panels. Studs are inserted through the clearance holes formed in the backing framework and plate and into the blind holes of the masonry panels after a suitable adhesive has first been poured into the blind holes. After the adhesive has set, nuts are engaged on the threaded rearward ends of the studs to join the masonry panels to the backing plate and frame. A disadvantage of this particular type of construction is that additional time and labor are required to form the clearance holes in the backing frame, backing plate, and blind holes in the masonry panels after these components have been placed together. It would be more expedient to perform the holes in the masonry panels and backing framework; however, because of the tolerance involved in locating the preformed holes, it would not be possible to ensure that the slabs are always properly aligned relative to each other and relative to the backing frame. Also, the attaching studs extend perpendicularly to the rear surface of the masonry panels, thereby providing less resistance against pullout than if the studs were skewed or diagonally disposed relative to the slabs. An example of this type of building wall panel is disclosed in U.S. Pat. No. 4,045,933.

U.S. Pat. No. 4,364,212 discloses a building wall panel constructed similarly to that disclosed in the above-described U.S. Pat. No. 4,045,933, with the exception that in the U.S. Pat. No. 4,364,212 patent, oversized blind bores are formed in the individual facing panels. The increased size of the blind bores reduces the strength of the interconnection between the studs and the facing panels.

U.S. Pat. Nos. 4,009,549 and 4,060,951 disclose systems for mounting individual masonry panels to a building framework with rather complicated bracket assemblies composed of a plurality of individual interconnecting brackets that may be adjusted relative to each other to accommodate variations in the locations that mounting openings are formed in the masonry panels. The bracket elements are bolted together by appropriate hardware. One drawback of this type of construction is that if the hardware becomes loosened or workmen neglect to install or properly tighten the hardware, the masonry panels may become detached from the building frame.

Accordingly, it is the principal object of the present invention to provide large building wall panels composed of a plurality of thin masonry panels that are conveniently and securely attached to a metal backing framework that in turn can be directly mounted on a building frame structure.

It is a particular object of the present invention to provide a building wall panel wherein the system for attaching masonry panels to a backing framework is capable of accommodating variations in the locations that mounting holes are formed in the masonry panels.

It is a further object of the present invention to provide a building wall panel wherein hardware attached to masonry panels are interconnected to associated hardware carried on a backing framework through the intermediacy of a bonding medium capable of accommodating variations in the locations of the hardware.

SUMMARY OF THE INVENTION

The foregoing and other objects are achieved in accordance with the present invention by constructing a building wall panel that includes an exterior facing of thin masonry panels, such as granite or marble, positioned in edge-to-edge relationship to each other. The panels are mounted on a backing frame by the use of a plurality of attachment assemblies, each including a first attachment subassembly anchored to the masonry panels, a second attachment subassembly anchored to the backing frame, and a bonding medium surrounding and securing the first and second attachment subassemblies to each other. By this construction, since the first and second attachment subassemblies are not directly interconnected with each other, variations in relative locations and alignment between the first and second subassemblies may be accommodated by the bonding medium so that the first attachment subassemblies may be preassembled to the masonry panels and so that the backing frame may be preconstructed and the second attachment subassembly preassembled to the backing frame prior to the mounting of the masonry panels onto the backing frame. As a consequence, the manual labor required to construct and assemble the building wall panel is significantly reduced.

In another aspect of the present invention, the first attachment subassembly has portions that extend rearwardly from the back side of the masonry panels to form a loop or bight that is open in the direction facing the back side of the panels. The second attachment subassembly includes portions that project from the backing frame to extend between the bight formed by the first attachment subassembly and the back surfaces of the masonry panels. As a consequence, if the masonry panels move any significant distance relative to the backing frame, these portions of first and second attachment subassemblies lock directly against each other to prevent detachment of the masonry panel from the backing frame.

According to a more detailed aspect of the present invention, the first attachment subassembly includes a pair of diagonally disposed elongate members that engage within corresponding openings formed in the back side of the masonry panels. The elongate members either entirely or partially form the bight that is open in a direction toward the rear surfaces of the masonry panels.

In accordance with another aspect of the present invention, the second attachment subassembly includes enclosure members are secured to the backing frame for defining pockets for receiving the first attachment subassemblies rearwardly therein. The pockets also serve to retain said first bonding medium therein. The second attachment subassemblies also include crosspins that extend outwardly from the backing frame and through the pockets at locations between the bight formed by the first attachment subassembly and the rear surfaces of the masonry panels to engage with portions of said enclosure member on the opposite side of the pocket.

A further aspect of the present invention includes a method of forming large building wall panels from exterior facing panels of thin granite or marble material. The method includes the steps of securing first attachment subassemblies to the back side of the masonry panels to extend rearwardly to form a bight that is open in the direction facing the back side of the panels. Another preliminary assembly procedure includes forming a backing frame with portions of second attachment subassemblies in the form of enclosure members that define pockets. A plurality of the pre-sized, thin masonry panels are placed in edge-to-edge relationship to each other on a supporting form and then the backing frame is placed on the facing panels so that first attachment subassemblies extend rearwardly within a corresponding pocket. Next, additional portions of second attachment subassemblies in the form of crosspins are engaged with corresponding enclosure members to extend through the pocket between the bight formed by the first attachment subassembly and the corresponding masonry panel. The pockets are filled with a bonding medium which when cured rigidly secures the first attachment subassembly to the backing frame.

BRIEF DESCRIPTION OF THE DRAWINGS

The details of a typical embodiment of the present invention will be described in connection with the accompanying drawings, in which:

FIG. 3 is an enlarged, fragmentary cross-sectional view of the building wall panel shown in FIG. 2 taken substantially along line 3—3 thereof;

FIG. 4 is an enlarged, fragmentary cross-sectional view of the present invention shown in FIG. 2 taken substantially along line 4—4 thereof;

FIG. 6 is a pictorial view of additional typical steps in forming a building wall panel in accordance with the present invention specifically illustrating placing a support frame within the mold to rest on the masonry panels such that the studs extending rearwardly from a back side of the masonry panels engage within a corresponding pocket formed on the frame, engaging a crosspin through the pockets and spraying a bonding medium within the pockets;

DETAILED DESCRIPTION OF THE INVENTION

Figure 1:
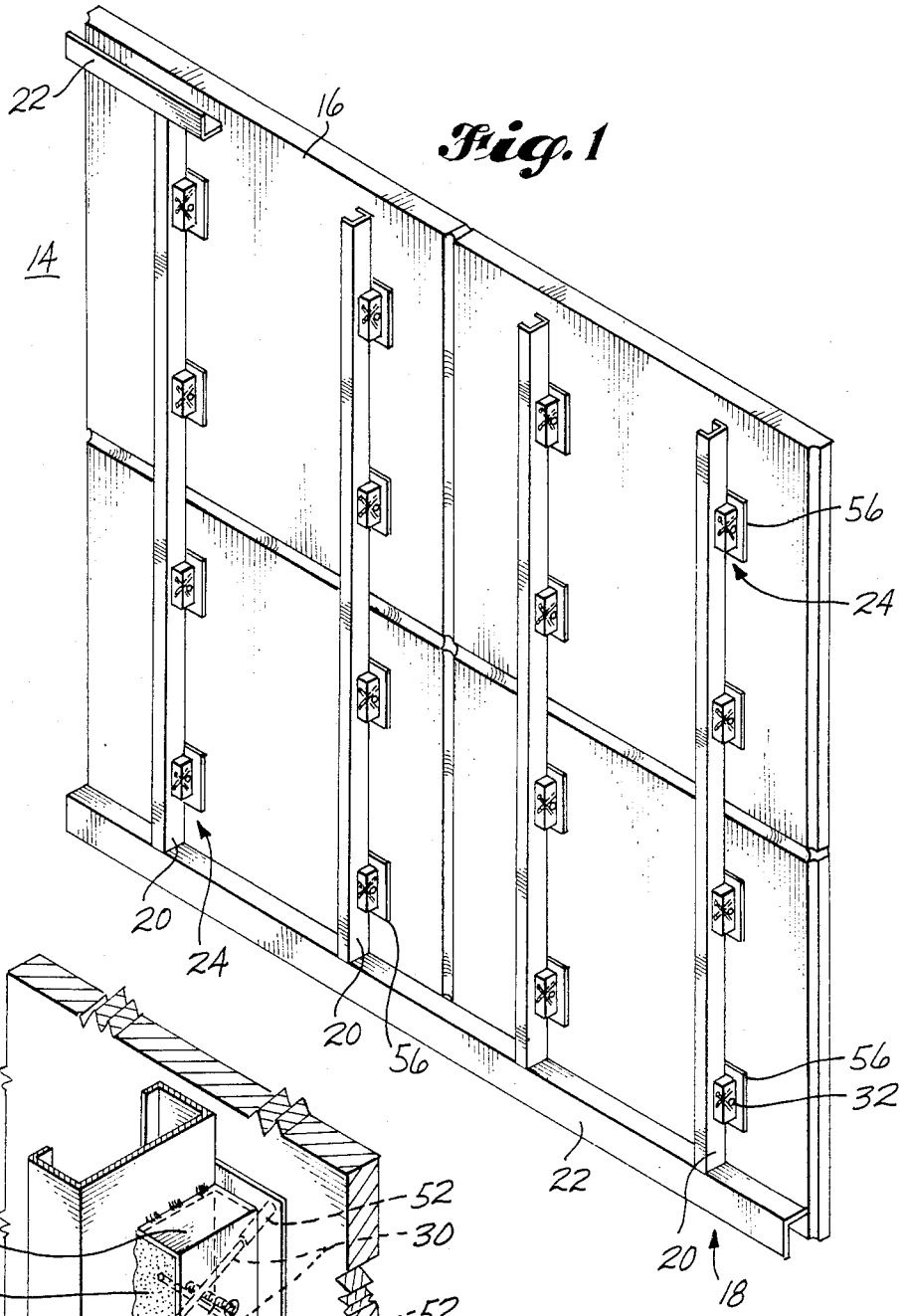
FIG. 1 is an isometric view of a building wall panel constructed according to the present invention as viewed from the rear side of the panel.

FIGS. 1–4 illustrate a building wall panel 14 constructed according to best mode of the present invention currently known to applicant, with the building panel including a plurality of thin, pre-sized masonry panels 16 arranged in edge-to-edge relationship to each other. A support frame 18, composed of a plurality of individual, elongate studs or upright members 20 and cross members 22, serves as a support and backing structure for panel 16. A plurality of attachment assemblies 24 are employed to securely mount masonry panels 16 on support frame 18. Each attachment assembly 24 also includes a first subassembly composed in part of a pair of threaded studs 30 extending diagonally, rearwardly and towards each other from panel 16 to extend within a pocket 28 formed by an enclosure member of a second attachment subassembly secured to support frame upright members 20. Studs 30 are of sufficient length to cross each other at a location within the interior of pocket 28. The second attachment subassembly also includes a crosspin 32 that extends transversely through the pocket at a location rearwardly of panel 16 and forwardly of the location at which studs 30 cross each other. Pocket 28 is filled with a bonding medium 34 that is sprayed or otherwise placed into the pocket in slurry or other fluid form. After the bonding medium solidifies, it creates a rigid interconnection between studs 30 and crosspin 32 and support frame 18 thereby to securely mount masonry panels 16 on the support frame.

It will be appreciated that by the above construction, relatively large building panels 14, up to at least 300 square feet, may be efficiently and conveniently constructed in a plant or factory utilizing automated equipment at a location remote from the building site. The completed panels can then be transported to the building site and then mounted directly to the building framework, not shown, to serve as both the exterior and interior walls of the building.

Figure 5:
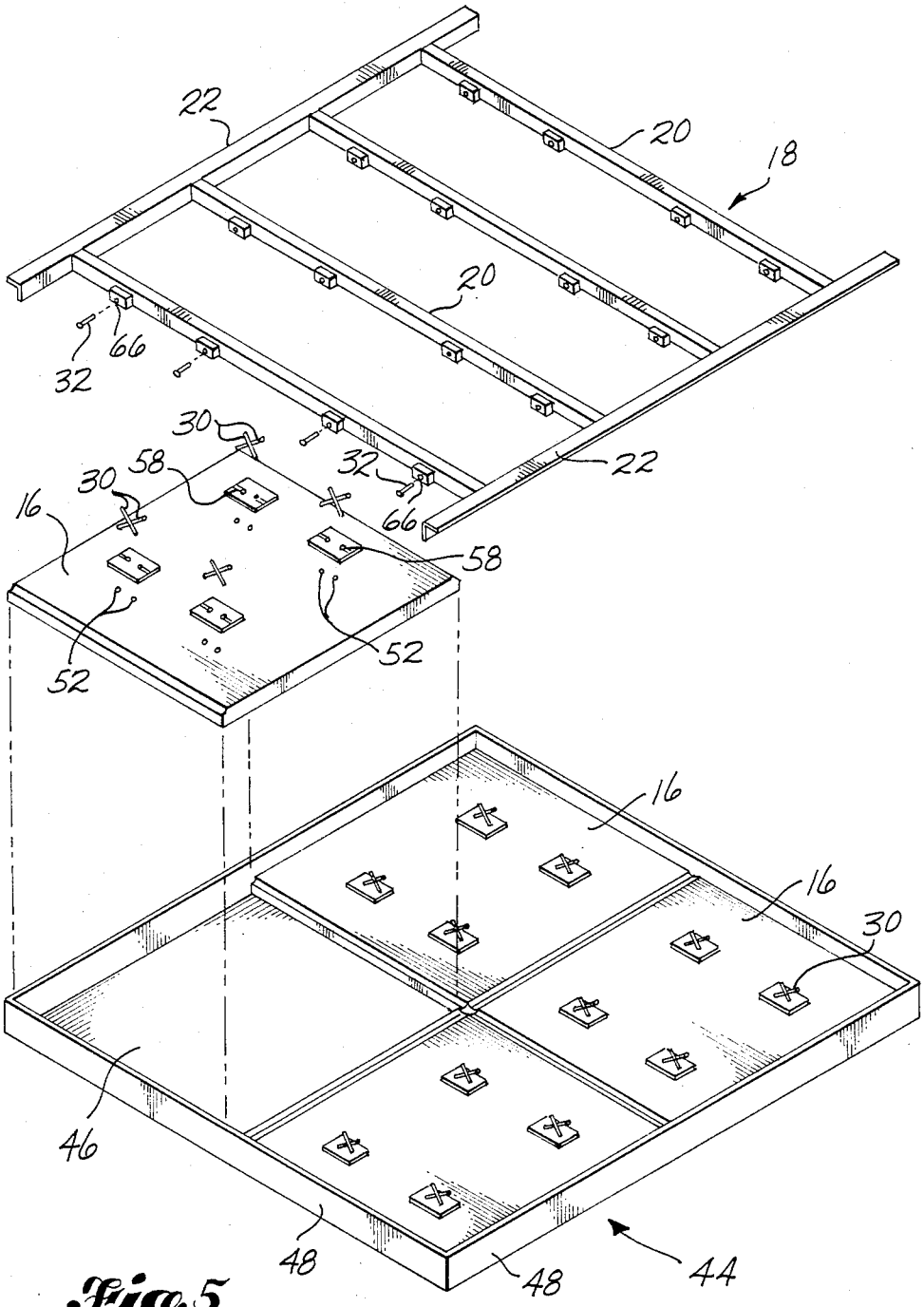
FIG. 5 is a pictorial view showing the typical initial steps of constructing a wall panel in accordance with the present invention, wherein paris of blind holes are formed in the backsides of masonry panels, studs are anchored within the blind holes, thermally insulating pads are engaged with the stud pairs and a plurality of masonry panels are arranged face down in adjacent relationship on a mold structure.

Now referring additionally to FIGS. 5 and 6, one typical method of forming building wall panel 14 in accordance with the present invention will next be described. A building wall panel mold or form, generally designated as 44, is constructed in the shape of the desired finished building wall panel. Although building wall panel 14 is illustrated as generally rectangular in shape, it will be understood that other shapes of building wall panels and, thus, corresponding shapes of forms for building wall panels may be used in the practice of the present invention. Form 44 is constructed from a flat, smooth support surface 46 and elongate edge members 48 extending around the perimeter of the support surface. Edge members 48 are removably secured to the support surface and detachably secured to each other by any convenient means, such as by the use of nails or hinges, which are old per se and do not constitute a part of the present invention. The size of form 44, of course, depends upon the desired size of the finished wall panel 14.

Ideally, masonry panels 16 are composed of granite, marble or other hard stone material which is not only durable and requires low maintenance, but also very pleasing in appearance. Due to the high structural integrity of wall panel 14 of the present invention, facing panels 16 may be cut relatively thin, i.e., as little as one-half inch, but generally between one-half and one inch in thickness. Although panels 14 are illustrated as rectangular in shape, they may be cut in other shapes, as desired. Moreover, panels 14 may be cut in different sizes so that either a relatively few or relatively large number of individual panels are required to cover support frame 18.

Prior to placing panel 16 into form 44, pairs of diagonally disposed blind holes 52 are formed in the back sides of the panels. As discussed more fully below, the location of holes 52 correspond to the locations of pockets 28 disposed on support frame 18. Ideally, the holes are formed at an angle of approximately 45 degrees to the rear surface of panels 16. As shown in FIG. 4, also ideally the distance HS separating each pair of holes is somewhat less than the height HP of pockets 28 to allow support frame 18 to be adjusted in position relative to panels 16 to accommodate tolerances in the location of holes 52, upright members 20 of support frame 18 and pockets 28. Also shown in FIG. 4, holes 52 are slightly offset from each other so that when studs 30 are disposed therein the studs are in close side-by-side proximity to each other. The overall width WS of the two studs is somewhat less than the width WP of pockets 28 also to accommodate sideways variations in the relative locations of holes 52, upright members 20 and pockets 28.

A first attachment subassembly in the form of studs 30 are secured within holes 52 before panels 16 are placed within form 44 by the use of an appropriate adhesive, such as an epoxy resin. The resin not only secures studs 30 within holes 52, but also fills the small gap between the holes and the close fitting studs to form a boundary layer therebetween so that when the epoxy hardens, a uniform contact is formed between the hole and the stud surface. As a consequence, the bearing load imposed on the studs by the weight of panels 16 is distributed generally uniformally about the exterior surface of the studs thereby reducing the possibility that unacceptably high stresses will be imposed on the studs or the interior surface of holes 52. Preferably, studs 30 are constructed from a rigid, high strength, substantially rust resistant material, such as stainless steel rod stock. Also, ideally the studs are threaded throughout their length to reduce a possibility of longitudinally shifting within holes 52 or shifting relative to bonding medium 34 within pockets 28. As illustrated most clearly in FIG. 3, preferably studs 30 cross each other at a central portion of pocket 38 and are of sufficient length to extend through substantially the full fore-and-aft depth of the pockets to achieve a secure as possible interconnection with bonding medium 34. It will be appreciated that the number of pairs of studs 30 per masonry panels 16 may be varied in response to the size and thickness of the panels, the type of facing material selected, and the environment in which the building panel will be placed.

As most clearly shown in FIGS. 2–5, a thin insulation pad 56 is positioned at the location of each pair of stud holes 52 to space support frame 18 slightly rearwardly of the back sides of masonry panels 16 and form a closure for the sides of pockets 28 adajacent the rear face of the masonry panels to contain bonding medium 34 when initially placed into pockets 28. To this end, pads 56 are preferably large enough to overlap the margins of pocket 28 and underlie the adjacent portions of frame upright members 20. Preferably pads 56 are composed of impervious, somewhat resilient material to enable the pads to compress slightly to accommodate variations and the thickness of masonry panels 16, which typically is in the range of approximately 1/16th of an inch. Also preferably pads 56 are constructed from thermally insulating material to reduce the possibility that hot spots will be formed at the locations of holes 52 due to heat transfer through studs 30. In cold weather, due to variations in the collection of moisture on the exterior surface of masonry panels 16, such hot spots could cause the exterior surface of panel 16 located adjacent studs 30 to be of a different color than the remainder of the panel. In addition to the above described advantages and functions of pad 56, it will be appreciated that the pad also serves as a bond breaker to prevent adherence between bonding medium 34 within pockets 28 and the rear surface of masonry panels 16 so that relative movement can take place therebetween, for instance, due to variations in thermal expansion rates.

Pads 56 may be positioned over holes 52 before studs 30 are bonded within the holes, in which case, ideally a pair of clearance holes are preformed within the pads at locations corresponding to the relative locations between holes 52. After studs 30 are inserted within holes 52, the studs will hold pads 56 in place. Alternatively, pads 56 may be constructed with clearance holes for studs 30 and with slits 58 extending between the clearance holes and the margins of the pad so that the pads can be implaced after panels 16 are arranged within form 44, thereby reducing the possibility that the pads will be damaged, especially if constructed from materials that are somewhat easily broken or torn, such as styrofoam.

After studs 30 and pads 56 are assembled on panels 16 and the panels are arranged within form 44, a previously assembled support frame 18 is placed within the form to overlie the masonry panels. As discussed above, support frame 18 is spaced slightly rearwardly or upwardly from the back side of panels 16 by pads 56. In a preferred form of the present invention illustrated in the accompanying figures, support frame 18 is composed of a plurality of elongate, upright members 20 in the form of channels which are arranged in spaced-apart, parallel relationship to each other, in a manner similar to the studs of a conventional wall structure. The ends of upright members 20 are interconnected by cross members 22 illustrated in the form of angle members. Cross members 22 are secured to the ends of upright members 20 by any convenient means, such as by weldments. It will be appreciated that the sizes of upright members 20 and cross members 22 may be varied to accommodate various factors, such as the size of building wall panel 14, the thickness, and, thus, the weight of masonry panels 16, the spacing between the upright members. Ideally upright members 20 are spaced-apart from each other typically on about 24 inch centers. It is to be understood, however, that depending upon the use of building panel 14, the overall size of the panel, the cross-sectional dimensions of upright members 20, and other factors, the upright members may be positioned more closely adjacent to each other or separated further apart from each other without departing from the scope of the present invention. Also, of course, the length of upright members 20 and cross-members 22 may be varied depending upon the desired size of building panel 14. If required, diagonal braces or similar reinforcing members, not shown, may be used to reinforce upright members 20 and cross members 22, especially if the building panels are formed in large spans, for instance, in lengths of over 20 feet. Although upright members 20 are illustrated as formed from channel members and cross members 22 are illustrated as formed from angle members, other structural compounds may be utilized, such as I-beams, square or rectangular tubings, or Z-sections.

Referring specifically to FIGS. 1–4, a second attachment subassembly in the form of enclosure members 26 are attached to the web portions of upright members 20 at locations corresponding to the locations of stud pairs 30. In a preferred embodiment of the present invention, enclosure members 26 are in the form of a channel having a side panel 60 spaced from the web of upright member 20 and top and bottom panels 62 and 64 interconnecting the upper and lower edge portions of the side panel with the upright member web. As such, enclosure member 26 defines a pocket 28 having a forward opening located flush with the forward edge of upright member 20, i.e., the edge adjacent panel 16, and a rearward opening at the opposite end of the pocket. As discussed above, the forward opening of pocket 28 is closed off by pad 56. Enclosure members 26 are welded or otherwise attached to upright members 20 when the upright members are being welded or otherwise assembled with cross members 22 or even prior to that time. Ideally for economy of construction, enclosure members 26 comprise the same structural material used to form upright members 20; nevertheless, it will be appreciated that the enclosure member may be constructed in other shapes and from other types of structural material without departing from the spirit or scope of the present invention.

Figure 2:
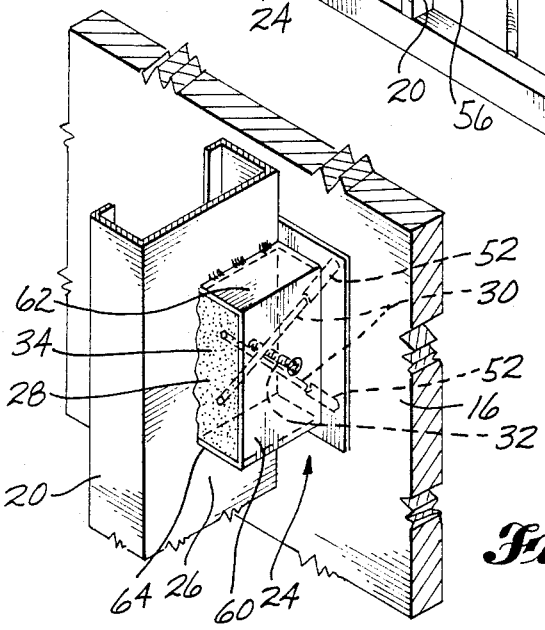
FIG. 2 is an enlarged, fragmentary isometric view of the building wall panel illustrated in FIG. 1 specifically showing the manner in which the masonry panels are secured to a backing framework.

As most clearly shown in FIGS. 2, 3 and 4, the height HP of pocket 28 is somewhat larger than the overall height HS defined by the locations at which studs 30 emerge rearwardly from blind holes 52 formed in panel 16, and the width WP of the pocket is somewhat wider than the overall width WS of studs 30. Also, ideally upright members 20 and enclosure members 26 are positioned so that pockets 28 are nominally centered relative to the height HS and width WS of studs 30 so that when frame 18 is placed over panels 16, pockets 28 engage over studs 30, with the clearance between pockets 28 and the height and width of studs 30 serving to accommodate manufacturing and machining tolerances in the locations of blind holes 52 in panels 16, the size of panels 16, the location of upright members 20, the location of enclosure members 26, and other variables associated with the manufacture of building panel 14. It will be appreciated that by this construction, blind holes 52 may be predrilled or otherwise preformed in panels 16 and studs 30 preassembled within the blind holes prior to the step of placing support frame 18 over the rear surfaces of masonry panels 16 while at the same time virtually eliminating the likelihood of interference between studs 30 and enclosure member 26. It also will be appreciated that if blind holes 52 are required to be drilled in panels 16 after support frame 18 is positioned over the back sides of the panels or if enclosure members 26 are required to be secured to upright members 20 after support frame 18 is placed over the back side of panels 16, considerably greater manufacturing time would be required to form building panel 14, thereby significantly increasing cost of the panel. Also, because of the unavoidable variation in the sizes of panels 16 and in the locations of blind holes 52, it is not practical to attempt to locate the holes so that studs 30 may be welded or otherwise mounted directly to upright members 20.

It will be appreciated that the size of enclosure member 26 may be varied to accommodate various factors that affect the precision with which studs 30 are located relative to pocket 28, such as the overall size of building panel 14 and the number and size of the individual masonry panels 16.

After support frame 18 is positioned over the back sides of masonry panels 16, FIG. 6, crosspins 32 of the second attachment subassembly are engaged through clearance holes 66 preformed in enclosure member side panel 60, through the interior of pocket 28 to threadably engage with an aligned opening preformed in the web portion of upright member 20. As shown in FIG. 3, pin 32 passes through pocket 28 at a location slightly forwardly of the location at which studs 30 cross each other, i.e., slightly forwardly of the bight formed by the studs. Pin 32 reinforces the bonding medium 34 that fills pocket 28 and also functions as a fail-safe mechanism to lock or bear against studs 30 if panel 16 moves any appreciable distance outwardly away from or vertically relative to support frame 18. It will be appreciated that if this occurs, pin 32 would be loaded in shear enabling it to carry a substantial load. Also, studs 30 would be loaded in tension, bending and shear, enabling the studs and the adhesive utilized to effectively anchor the studs within holes 52 which may not be possible if the studs were simply loaded in tension.

Due to tolerances in the locations of holes 52 relative to pockets 28, it is possible that clearance hole 66 might be located rearwardly of one or both of the corresponding studs 30. If this occurs, studs 30 may be flexed rearwardly so that crosspins 32 can be installed at proper location, i.e., forwardly of the studs as shown in FIG. 3.

Ideally, crosspins 32 are formed from corrosion resistant material, or coated with a corrosion resistant coating, such as by galvanizing. It will be appreciated that the size of pin 30 may be varied to accommodate the load imposed thereon by masonry panels 16. Also ideally pin 30 is threaded substantially along its entire length to enhance its ability to reinforce bonding medium 34.

After crosspin 32 is installed in the manner described above, pockets 28 are filled with a bonding medium that is sprayed or otherwise placed within the pockets in slurry form to completely fill the pockets. As noted above, the bonding medium is sealed against leaking out of the bottom or forward end of pockets 28 by pads 56.

A preferred form of the present invention, the bonding medium is composed of cementacious material reinforced with high strength fibers, such as glass fibers. As a nonlimiting example, the cementacious material may be composed of approximately ten parts by weight of cement with approximately three parts by weight sand and approximately four parts by weight water to form a flowable mixture. It is to be understood that the weight of the sand can be varied from near zero to approximate equal to the weight of the cement without departing from the spirit or scope of the present invention. The cement, sand and water may be mixed in a conventional concrete mixer, not shown, then pumped into a sprayer 70 through line 72. Compressed air is supplied to sprayer 70 through hose 74.

A substantially continuous strand of alkali resistant reinforcing fiber, such as glass fiber, is fed into a conventional chopper mechanism, not shown, associated with sprayer 70 from a roll or the like. The glass fiber is chopped into a plurality of short segments and mixed with the concrete in the known matter to form a slurry of concrete and chopped glass fiber strands. The percentage of chopped glass fiber in the slurry may be varied, ideally in the range of from two to six percent of the weight of the concrete, as desired to meet the strength requirements of building wall panel 14. The length of the chopped glass fibers may be varied, but it has been found that a length of approximately one and one-half inches in satisfactory in most instances. The glass fiber strands must be alkali resistant to prevent breakdown when mixed with the concrete. One type of glass fiber which has been found to be satisfactory is marketed under the name CEM-FIL Alkali Resistant Glass Fiber by CEM-FIL Corporation of Nashville, Tenn. The chopped glass fiber strands have a random orientation with respect to each other when they are mixed with the concrete.

As shown in FIG. 6, sufficient bonding material is sprayed into pockets 28 to substantially fill the pockets. Thereafter, the bonding medium is allowed to cure, e.g., for 24 hours if glass fiber reinforced concrete is used. It is to be understood that although the curing time is only approximate and may be varied to accommodate the opposition of the bonding medium and the size of pocket 28, this curing time is substantially less than would be required if the entire rear surfaces were covered with cementacious bonding material as has typically been done in the past.

After building wall panel 14 has been cured, if requred, a conventional caulking material, not shown, may be applied between adjacent edges of panels 16, especially if the panels are positioned angularly to each other rather than the flat plane shown in FIG. 1.

Figure 7:
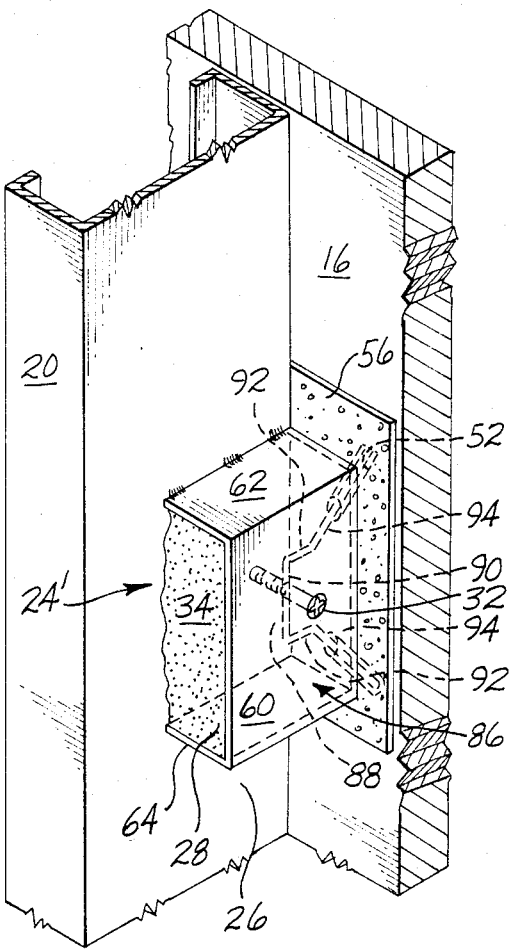
FIG. 7 is an enlarged, fragmentary isometric view of another typical embodiment of the present invention illustrating an alternative manner of securing masonry panels to a backing framework.

Although masonry panels 16 are illustrated in FIGS. 1–6 as mounted on support frame 18 through the use of a pair of diagonally disposed, elongate, straight studs 30, other attachment assemblies employing other types of mounting members may be used in place of the studs. For instance, FIG. 7 illustrates an attachment assembly 24' that employs a first attachment subassembly in the form of a single, formed attachment member 86 having a looped or U-shaped central portion 88 composed of a transfer central member 90 and a pair of parallel, elongate side portions 92 extending transversely from opposite ends of the central portion. Attachment member 86 also includes a pair of diverging distal portions 94 extending diagonally forwardly and outwardly from the ends of side members 92 opposite cross member 90 to engage within blind holes 52. Attachment member 86 is constructed from high strength, but somewhat flexible material to permit side members 92 to be deflected inwardly toward each other when engaging diverging portions 94 within blind holes 52. Ideally, the diverging portions of the attachment member are anchored within the blind holes with the same type of adhesive utilized to anchor studs 30 within the blind holes, discussed above. Except for the use of attachment member 86 in place of studs 30, the construction of attachment assembly 24' is substantially identical to attachment assembly 24 discussed above.

It will be appreciated that central portion 88 of attachment member 86 defines a forwardly open bite through which crosspin 32 extends transversely across. It also will be appreciated that it is not possible for attachment member 86 to disengage from crosspin 32, except by failure of the attachment member or the crosspin. As a consequence, a simple but extremely secure mounting arrangement is achieved for mounting masonry of panels 16 onto support frame 18.

Figure 8:
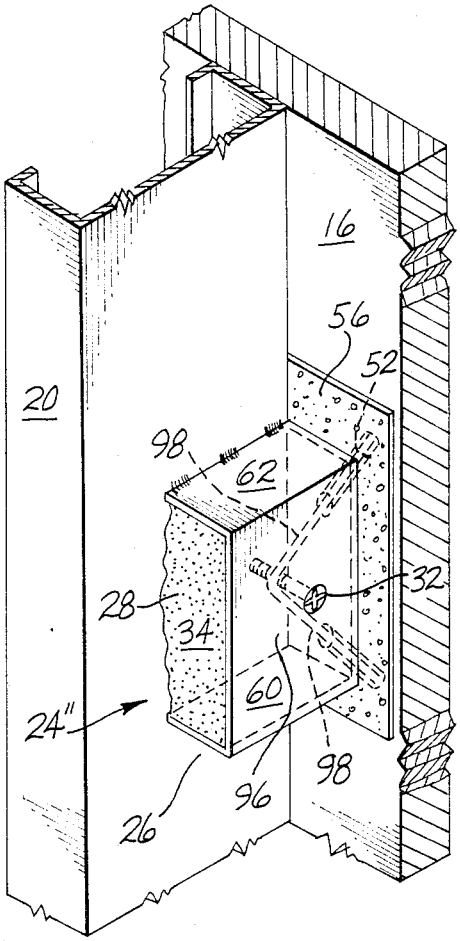
FIG. 8 is an enlarged, fragmentary isometric view of a further typical embodiment of the present invention illustrating another alternative manner of securing masonry panels to a backing framework.

In a further typical form of the present invention, as illustrated in FIG. 8, attachment assembly 24'' utilizes a first attachment subassembly in the form of a V-shaped attachment member 96 composed of a pair of diagonally disposed legs 98 that snugly engage within blind holes 52. As with studs 30, legs 98 are secured within the blind holes by an appropriate adhesive. Legs 98 together form a forwardly open bight in a manner similar to the bight defined by studs 30 or to the bight formed by central portion 88 of attachment member 86. As in the other typical embodiments of the present invention illustrated in FIGS. 1–7, pin 32 extends transversely through the bight defined by legs 98. Also as in attachment assemblies 24 and 24', in attachment assembly 24'' the use of diagonally disposed legs 98 of attachment member 96 assists in securely anchoring attachment member 96 within holes 52 so that the loading on legs 98 is not solely in tension tending to pull the legs out of holes 52, but also in shear and bending. Except for the use of attachment member 96 in place of studs 30, the construction of attachment assembly 24'' is substantially identical to attachment assembly 24 discussed above.

There have been described preferred embodiments of a building panel 14 having a masonry facing, preferably of granite or marble, and a method of making the building panel in accordance with the present invention. The terms granite and marble have been used interchangeably since the present invention is believed to have solved problems which have existed with respect to the use of both of these natural stones as either exterior or interior wall coverings. It will be appreciated by those skilled in the art of the present invention that the teachings of this invention may be used to advantage in any situation where it is desired to provide a large, relatively lightweight building panel with a facing of natural masonry material, such as marble or granite, also where the wall panel may be finished on both of its sides. Therefore, it is to be understood by those skilled in the art that various changes, additions and omissions may be made in the form and the detail of the description of the present invention set forth above without departing from the spirit or essential characteristics thereof. The particular embodiments of the building panel 14, described above, is therefore to be considered in all respects as illustrative and not restrictive, i.e. the scope of the present invention is as set forth in the appended claims rather than being limited to the examples of building wall panel 14 set forth in the foregoing description.

The embodiments of the invention in which an exclusive property or privilege is claimed are defined as follows:

1. A preformed building wall panel for mounting on a building frame structure, comprising:

a. at least one masonry panel having:
an outer surface and a back surface; and
a plurality of pairs of blind holes extending through the back surface and extending partially through said masonry panel;

b. a support frame for supporting said masonry panel;

c. first attachment means having leg members snugly engaged within said pairs of blind holes formed in said masonry panel said first attachment means extending rearwardly from the back surface of said masonry panel to form a bight that is open in the direction facing the back surface of said masonry panel;

d. means for forming an individual pocket associated with and surrounding each of said first attachment means, each of said pocket forming means being secured to said mounting frame;

e. second attachment means extending through a corresponding pocket at a location between the bight portion of said first attachment means and the back surface of said masonry panel; and, f. bonding medium disposed within and filling said pockets to securely anchor the bight portion of each first attachment means within its corresponding pocket.

2. The building wall panel according to claim 1, wherein said second attachment means are engaged with and retained by said support frame and a corresponding pocket forming means.

3. The building wall panel according to claim 1, wherein said masonry panel is composed of granite.

4. The building wall panel according to claim 1, wherein said masonry panel is composed of marble.

5. The building wall panel according to claim 1, wherein said support frame is composed of a plurality of interconnected metal structural members.

6. The building wall panel according to claim 5, wherein at least some of said structural members include portions extending transversely to said masonry panel, and said second attachment means project outwardly from said transverse portions of said structural members through said pocket to engage said pocket forming means.

7. The building wall panel according to claim 1 wherein said first attachment means comprises a pair of individual elongate leg members extending diagonally rearwardly and toward each other from the backside of said masonry panel a sufficient distance that said leg members cross each other; and, means for anchoring said elongate leg members to said masonry panel.

8. The building wall panel according to claim 7, wherein said second attachment means extends between the backside of said masonry panel and the location at which said elongate leg members cross each other.

9. The building wall panel according to claim 7 wherein said elongate leg members are nominally substantially straight.

10. The building wall panel according to claim 7, wherein said elongate leg members are threaded.

11. The building wall panel according to claim 7, wherein said anchor means includes a second bonding medium for forming a boundary layer between said openings and their associated elongate leg members and for securing said elongate leg members within an associated hole.

12. The building wall panel according to claim 1:

wherein said blind holes extending through the back surface of said masonry panel for snugly receiving the forward portions of said leg members are diagonally disposed relative to each other; and, said first attachment means having portions for interconnecting the rearward portions of said leg members to form together with said leg members an integral, unitary structure having a bight that is open in the direction facing toward the back surface of said panel.

13. The building wall panel according to claim 12, wherein the rearward portions of said leg members are interconnected directly to each other.

14. The building wall panel according to claim 12, wherein said first attachment means includes a loopedshaped member secured to the rearward portions of said leg members.

15. The building wall panel according to claim 1, wherein said pocket forming means include portions spaced from said backing frame to engagingly support portions of said second attachment means at a location distal from said backing frame.

16. The building wall panel according to claim 1, wherein said backing frame constitutes a portion of said pocket forming means.

17. The building wall panel according to claim 1, wherein said first bonding medium is composed of cementitious material.

18. The building wall panel according to claim 1, further comprising a thermally insulating panel disposed between each body of bonding medium and said masonry panels.

19. A method of forming a building panel from a plurality of relatively thin facing panels of masonry material, such as granite or marble, comprising the steps of:

a. forming a plurality of pairs of blind holes in the back surfaces of said facing panels;

b. placing the facing panels face down on a support;

c. snugly engaging the leg portions of first attachment means into the blind holes of said facing panels to extend rearwardly and define a bight that is open in a direction facing the backsides of the masonry panels;

d. forming a supporting frame with a plurality of spaced-apart pockets, an individual pocket being associated with each of said first attachment means;

e. placing said backing frame on the backsides of said facing panels so that each of said first attachment means extends rearwardly into a corresponding individual pocket;

f. engaging second attachment means with a corresponding pocket to extend through said pocket at a location between the bight of said first attachment means and the rear surface of a corresponding masonry panel; and, g. filling said pockets with a bonding medium thereby to rigidly attach said masonry panels to said support frame.

20. The method of claim 19, further including the step of inserting a thin, resilient thermally insulating pad between said masonry panels and said backing frame pockets before said pockets are filled with the bonding medium.

21. The method of claim 19, further including forming the bonding medium in slurry form from concrete and randomly oriented chopped glass fiber strands.

22. The method of claim 19, further including attaching covering means to the side of said backing frame opposite said masonry panels.

* * * * *